US009877122B2

(12) United States Patent
Flaig

(10) Patent No.: US 9,877,122 B2
(45) Date of Patent: Jan. 23, 2018

(54) HEARING DEVICE

(71) Applicant: SIVANTOS PTE. LTD., Singapore (SG)

(72) Inventor: Uwe Flaig, Feucht (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/153,961

(22) Filed: May 13, 2016

(65) Prior Publication Data

US 2016/0337766 A1 Nov. 17, 2016

(30) Foreign Application Priority Data

May 13, 2015 (DE) ..... 10 2015 208 845

(51) Int. Cl.
*H04R 25/00* (2006.01)

(52) U.S. Cl.
CPC ..... *H04R 25/608* (2013.01); *H04R 25/604* (2013.01); *H04R 25/65* (2013.01); *H04R 25/658* (2013.01); *H04R 25/554* (2013.01); *H04R 2225/51* (2013.01)

(58) Field of Classification Search
CPC .... H04R 25/02; H04R 25/554; H04R 25/608; H04R 1/04; H04R 25/556; H04R 25/604; H04R 25/65; H04R 25/652; H04R 25/658; A61N 1/0541
USPC ..... 235/488; 257/664; 320/107; 340/10.1; 343/702, 745, 873, 895; 381/314, 315, 381/317, 318, 322, 323, 324, 60, 312, 381/313, 325, 326, 328, 330; 455/90.3, 455/41.3; 600/25; 607/55, 137
See application file for complete search history.

(56) References Cited

U.S. PATENT DOCUMENTS 6,046,707 A * 4/2000 Gaughan ..... H01Q 1/243 343/872
7,676,050 B2 3/2010 Sauer
8,014,551 B2 * 9/2011 Iwano ..... H04R 25/407 381/313
8,265,316 B2 * 9/2012 Saltykov ..... H04R 25/456 381/325
8,325,958 B2 * 12/2012 Rass ..... H04R 25/604 381/322
8,331,594 B2 * 12/2012 Brimhall ..... H04R 25/60 381/322
8,379,897 B2 * 2/2013 Schumaier ..... H04R 25/456 381/326
8,437,860 B1 * 5/2013 Crawford ..... H04R 25/60 607/1

(Continued)

FOREIGN PATENT DOCUMENTS

DE 102004017832 B3 10/2005
DE 102005012149 B3 9/2006

(Continued)

*Primary Examiner* — Gerald Gauthier
(74) *Attorney, Agent, or Firm* — Laurence A. Greenberg; Werner H. Stemer; Ralph E. Locher

(57) ABSTRACT

A hearing device includes a housing having an assembly opening and a housing cap for closing the assembly opening. The hearing device also includes a signal processing unit disposed in the housing and a sealing body for sealing the housing against the ingress of contaminants. Additionally, the hearing device includes an antenna body for wireless signal transmission with a separate device. This antenna body is embedded in the sealing body.

10 Claims, 2 Drawing Sheets

(56) References Cited

U.S. PATENT DOCUMENTS 8,698,682 B1 * 4/2014 Desclos ..... H01Q 1/243 343/745
8,755,551 B2 * 6/2014 Ritter ..... H04R 25/60 381/322
8,798,298 B1 * 8/2014 Burns ..... H04R 1/2876 264/267
8,848,955 B2 * 9/2014 Courtois ..... H04R 25/604 381/322
9,040,819 B2 5/2015 Kempf et al.
9,132,270 B2 * 9/2015 Vaishya ..... H04R 25/608
9,143,874 B2 * 9/2015 Angst ..... H01R 13/447
9,226,085 B2 * 12/2015 van Halteren ..... H04R 25/652
9,301,067 B2 * 3/2016 Moller ..... H04R 25/604
9,654,886 B2 * 5/2017 Barth ..... H04R 25/556
9,699,575 B2 * 7/2017 van Halteren ..... H04R 25/604
2002/0191806 A1 * 12/2002 Rohrseitz ..... H04R 25/558 381/323
2005/0244024 A1 11/2005 Fischer et al.
2007/0280496 A1 * 12/2007 Karamuk ..... H04R 25/656 381/328
2008/0095390 A1 * 4/2008 Gebert ..... H04R 25/652 381/323
2008/0212812 A1 * 9/2008 Chan ..... H04R 25/554 381/312
2009/0316940 A1 * 12/2009 Pander ..... H04R 25/456 381/323
2010/0158294 A1 6/2010 Helgeson et al.
2010/0208927 A1 8/2010 Ritter et al.
2011/0019830 A1 * 1/2011 Leibman ..... H01Q 1/273 381/60
2012/0034884 A1 * 2/2012 Sekine ..... H01Q 1/002 455/90.3
2012/0062428 A1 * 3/2012 Imano ..... H01Q 1/243 343/702
2012/0206239 A1 * 8/2012 Ikemoto ..... G06K 7/10346 340/10.1
2013/0010992 A1 * 1/2013 Koester ..... H04R 25/65 381/322
2013/0187594 A1 * 7/2013 Barth ..... H04R 25/602 320/107
2013/0188813 A1 * 7/2013 Waldmann ..... H04R 25/606 381/315
2013/0202139 A1 * 8/2013 Lackert ..... H04R 25/45 381/317
2013/0216077 A1 * 8/2013 Tipsmark ..... H04R 25/556 381/314
2013/0324047 A1 * 12/2013 Wells ..... H04R 5/033 455/41.3
2014/0044292 A1 * 2/2014 Bergner ..... H04R 25/658 381/322
2014/0121743 A1 * 5/2014 Leigh ..... H05K 5/0217 607/137
2014/0232610 A1 * 8/2014 Shigemoto ..... H01Q 1/36 343/873
2014/0374888 A1 * 12/2014 Ishida ..... H01L 23/66 257/664
2015/0227829 A1 * 8/2015 Finn ..... G06K 19/07752 235/488
2015/0264494 A1 * 9/2015 Cho ..... H04R 25/606 600/25
2016/0337766 A1 * 11/2016 Flaig ..... H04R 25/658

FOREIGN PATENT DOCUMENTS

DE 102011009860 A1 8/2012
EP 2219392 A2 8/2010

* cited by examiner

HEARING DEVICE

CROSS-REFERENCE TO RELATED APPLICATION

This application claims the priority, under 35 U.S.C. §119, of German Patent Application DE 10 2015 208 845.6, filed May 13, 2015; the prior application is herewith incorporated by reference in its entirety.

BACKGROUND OF THE INVENTION

Field of the Invention:

The invention relates to a hearing device, particularly to a hearing aid.

Hearing devices are usually used for outputting (acoustic) sound signals to an ear or a hearing center of a respective hearing device user. In most cases, to that end, hearing devices include a loudspeaker, frequently referred to as an "earpiece," that is worn directly in the auditory canal of the respective ear of the hearing device user or is acoustically connected to the auditory canal, for example by using an acoustic tube. Alternatively, a hearing device may also have, for the purpose of transmitting the sound signal, an associated bone conduction implant, a cochlear implant or the like. In that case, hearing devices are particularly in the form of hearing aids for compensating for a reduction in the hearing of the hearing device user and in most cases additionally include at least one microphone for capturing (ambient) sounds and also a signal processing unit through the use of which the captured sounds are filtered if need be and then output to the loudspeaker in amplified form. Alternatively, however, a hearing device may also be a so-called tinnitus masker, through the use of which a background or noise signal specific to the hearing device user is generated and output.

Some modern hearing devices have a device for (wireless) communication with a separate device. In most cases, a separate device of that kind is a control unit through the use of which processing settings can be (wirelessly) transmitted to the respective hearing device, or—in the case of a binaural hearing device system for aiding both ears of the hearing device user—it is a second hearing device. By way of example, the control unit may in turn be a smart phone on which a software application for controlling the hearing device is installed. Furthermore, the separate device may also be an audio signal source that transmits audio signals for playback to the hearing device, such as a TV set, a smart phone or the like, for example. By way of example, such audio signals are pieces of music, the sound signals otherwise output through the loudspeakers of the TV set or—if the hearing device is a head set—voice signals from a telephone as well.

It has been recognized that wireless communication (signal transmission) requires electrically conductive components in the hearing device that are used as an antenna. They are usually formed by metal structures, particularly by conductor tracks disposed on a printed circuit board. In that case, those structures may be integrated in a circuit carrier carrying the signal processing unit or may have a DC connection to the circuit carrier. Against the background of progressive miniaturization of hearing devices, however, the installation space requirement and also the assembly of a separate antenna are often problematic.

SUMMARY OF THE INVENTION

It is accordingly an object of the invention to provide a hearing device which overcomes the hereinafore-mentioned disadvantages of the heretofore-known devices of this general type and which is set up for wireless communication.

With the foregoing and other objects in view there is provided, in accordance with the invention, a hearing device which is preferably a hearing aid. In this case, the hearing device includes a housing that has an assembly opening and also a housing cap for closing the assembly opening. The hearing device additionally includes a signal processing unit, which is disposed in the housing, and also a sealing body for sealing the housing against the ingress of contaminants, such as liquid, earwax, dust, etc., for example. In this case, the sealing body is preferably set up and provided for sealing the housing from the inside thereof. That is to say that the sealing body, in the intended assembled state of the hearing device—that is to say with the housing closed—is disposed in the interior of the housing and is preferably not visible from the outside of the hearing device. The hearing device additionally includes an antenna body for wireless communication (i.e. signal transmission) with a preferably electronic device that is separate (from the hearing device). In this case, this antenna body is embedded in the sealing body (i.e. it is integrated therein).

By way of example, the separate device is a control unit that is set up and provided for wirelessly transmitting setting parameters for the signal processing unit to the hearing device. Alternatively, the separate device is a second, binaural hearing device or an electronic device that wirelessly transmits audio signals to the hearing device, such as a smart phone, a TV set or the like, for example.

The signal processing unit is preferably used for processing, i.e. for example for evaluation, filtering, analog/digital conversion and the like, of the signals received by using the antenna body ("radio signals"). Furthermore, the signal processing unit is particularly also used for processing sound signals that are captured by using a microphone that the hearing device possibly includes. The signal processing unit is particularly in the form of a nonprogrammable electronic circuit (e.g. in the form of an ASIC). Alternatively, the signal processing unit is formed by a microcontroller in which the functionality for performing the signal processing is implemented in the form of a software module.

The integration of the antenna body in the sealing body leads to a reduction in the number of individual parts that need to be handled during assembly of the hearing device. This advantageously saves assembly complexity. Furthermore, installation space may also advantageously be saved.

In accordance with another expedient feature of the invention, the antenna body has a two-dimensional, film-like or film-shaped structure. In this case and subsequently, "film-like" or "film-shaped" means that the wall thickness of the antenna body is small in comparison with the areal extent thereof. In this case, the surface area of the antenna body is preferably chosen to be of such magnitude that comparatively weak radio signals can also be received. Preferably, the surface area covered by the antenna body takes up approximately half or three quarters of the surface area covered by the housing, particularly by the housing cap. Due to the film-like or film-shaped structure, the antenna body is recognized to have low dimensional stability (i.e. it can collapse or be easily damaged during handling), as a result of which the integration in the sealing body means that the robustness and handlability of the antenna body is advantageously increased.

Expediently, the antenna body is formed from a metal, particularly from copper. This allows particularly good electrical conductivity and hence also high reception quality.

In accordance with a further preferred feature of the invention, the antenna body is overmolded with a plastic, particularly an elastomer, that forms the sealing body. That is to say that the antenna body forms an insert that is encased with the plastic of the sealing body in an injection molding process. The plastic is preferably a liquid silicone with injection molding capability (also referred to as "liquid silicone rubber" or LSR for short).

In accordance with an added expedient feature of the invention, the sealing body is particularly formed in the manner of a half-shell, so that the sealing body, in the intended assembled state, covers the signal processing unit, preferably at least one side of a circuit carrier carrying the signal processing unit and possibly a number of conductor tracks, entirely or at least in part in the manner of a hood. In this case, the shape of the sealing body is preferably aligned with the shape of the housing cap. Hence, the sealing body is constructed in such a way that during assembly, it is fitted, in a similar manner to the housing cap, over the signal processing unit (or the circuit carrier disposed at that location) disposed in the housing and is then covered with the housing cap. This allows particularly simple assembly of the sealing body, and also of the antenna body. In this case, the antenna body takes approximately at least half of the surface area of the sealing body. As a result, the antenna body has a three-dimensionally curved structure, which is advantageous for the reception quality of radio signals, and also advantageously a comparatively large surface.

In accordance with an additional preferred feature of the invention, the antenna body has an exposed contact section, i.e. one that is not overmolded with the plastic, through the use of which the antenna body is in contact with the signal processing unit, in particular indirectly through a conductor track of the circuit carrier, preferably by using a solder joint. In the case of a solder joint, the use of an LSR as material for the sealing body is particularly expedient, since a liquid silicone of this kind regularly has a thermal stability that is high in comparison with conventional elastomers with injection molding capability and hence is not damaged during the soldering process. As an alternative to the solder joint, the antenna body is in contact with the signal processing unit by using a compression joint, a plug connection or a spring contact, for example. In the latter case, it is conceivable, within the context of the invention, for the antenna body to be exposed only on an inside of the sealing body on a subregion of the surface area thereof. In the intended assembled state, this exposed subregion is in contact with the corresponding contact spring. In the case of spring-loaded contact, the antenna body is moreover preferably supported against the housing by using the sealing body, so that reliable electrical contact is rendered possible by using the spring contact. Within the context of the invention, it is additionally alternatively conceivable for the antenna body to be completely integrated in the sealing body and hence not exposed at any point. In this case, the antenna body is in contact with the signal processing unit through a sharp contact pin. This contact pin pierces the sealing body at least on the inside when the sealing body is assembled, and is therefore in DC contact with the antenna body.

In addition, the invention also allows inductive or capacitive, i.e. non-DC, coupling of the antenna to the signal processing unit. In this case, there is particularly no solid connection between the antenna body and the signal processing unit.

In accordance with yet another expedient feature of the invention, the hearing device includes at least one microphone for capturing acoustic signals preferably from the surroundings of the hearing device. In this case, the sealing body preferably has a damping section for elastically supporting the respective microphone against the housing. This damping section is preferably a region of the sealing body with an increased wall thickness, i.e. a thickening of the sealing body. The elastic support for the respective microphone advantageously reduces vibrations in the microphone itself and prevents or at least reduces transmission of structure-borne sound, i.e. vibrations in the housing or in other components of the hearing device, to the respective microphone. The integration of a damping function in the sealing body advantageously allows the number of individual parts of the hearing device to be reduced further and thus assembly complexity to be saved.

In accordance with yet a further preferred feature of the invention, a region of the housing that is closest to the microphone in the intended assembled state, particularly the housing cap, contains a microphone opening that corresponds to the respective microphone. This microphone opening allows the acoustic signal (sound signal) coming from the surroundings to strike the respective microphone virtually without attenuation. Expediently, the sealing body also has a perforation in the region of the respective damping section, preferably within the respective damping section, which perforation (in the intended assembled state) is disposed and constructed to correspond to the respective microphone opening. In this case, the damping section is expediently situated on the housing, particularly on the housing cap, in a ring around the respective microphone opening.

In accordance with a concomitant expedient feature of the invention, the (microphone) perforation or each (microphone) perforation in the sealing body contains a preferably hydrophobic and sound-transmissive barrier element for protecting the respective microphone against moisture and other contaminants. The barrier element preferably includes a "breathable" membrane that is formed particularly from a fine-pored (reticulate or nonwoven) and hydrophobic or hydrophobically coated material. Optionally, the membrane is also waterproof, for example in the form of a plastic film made of polyether ester or microporous polytetrafluoroethylene (PTFE for short). In this case, the respective barrier element is disposed in the perforation particularly so as to be replaceable, i.e. the barrier element can be removed for cleaning or repair purposes. To this end, the respective perforation preferably has an undercut that forms a pocket for the barrier element. This undercut has the respective barrier element retained in it, preferably in form-locking fashion. The barrier element is then pushed into the undercut preferably over an edge of the perforation that bounds the undercut for insertion into the respective undercut. The respective edge is elastically deformed in the process and subsequently "snaps" back over the barrier element, so that the barrier element is form-lockingly located in the undercut. As a result of this development, the sealing body has a particularly high level of functional integration, which means that the assembly complexity can be reduced further.

Other features which are considered as characteristic for the invention are set forth in the appended claims.

Although the invention is illustrated and described herein as embodied in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
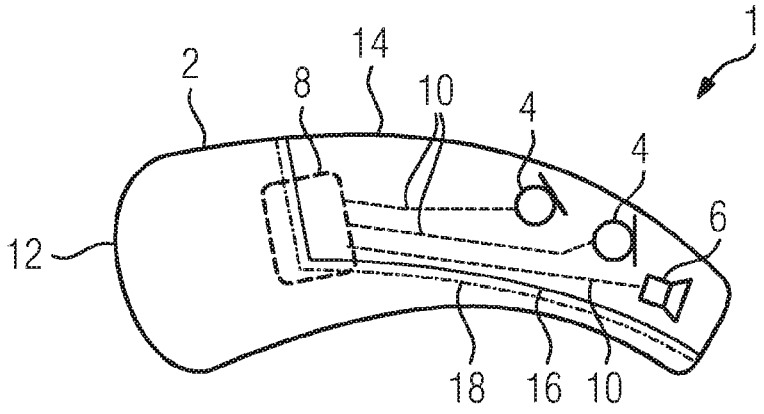
FIG. 1 is a diagrammatic, side-elevational view of a hearing device.

Referring now in detail to the figures of the drawings, in which mutually corresponding parts are provided with the same reference symbols throughout, and first, particularly, to FIG. 1 thereof, there is seen a hearing device 1 that is in the form of a hearing aid. The hearing device 1 includes a housing 2 for accommodating electronic components of the hearing device 1. In the present exemplary embodiment, the electronic components are formed by two microphones 4, by a loudspeaker 6 and by a signal processing unit 8 that is connected (for signal transmission purposes) between the two microphones 4 and the loudspeaker 6. Furthermore, the electronic components include a circuit carrier, which is not shown in more detail, on which a number of conductor tracks 10 for making an electrical contact connection from the microphones 4 and the loudspeaker 6 to the signal processing unit 8 are formed. In order to assemble the microphones 4, the loudspeaker 6 and the signal processing unit 8 (and also the circuit carrier) in the housing 2, the latter includes a basic body 12 in which an assembly opening is formed, and also a (shell-shaped) housing cap 14 for closing the assembly opening. In order to seal a closing edge 16, which is formed between the basic body 12 and the housing cap 14, against infiltration of contaminants, specifically of moisture or liquids (e.g. perspiration, rain water and the like) and hence to protect the electronic components, the hearing device 1 includes a sealing body 18 (indicated by a dash-dot line in FIG. 1). This sealing body 18 is disposed in the interior of the housing 2 so as to cover the closing edge 16.

Figure 2:
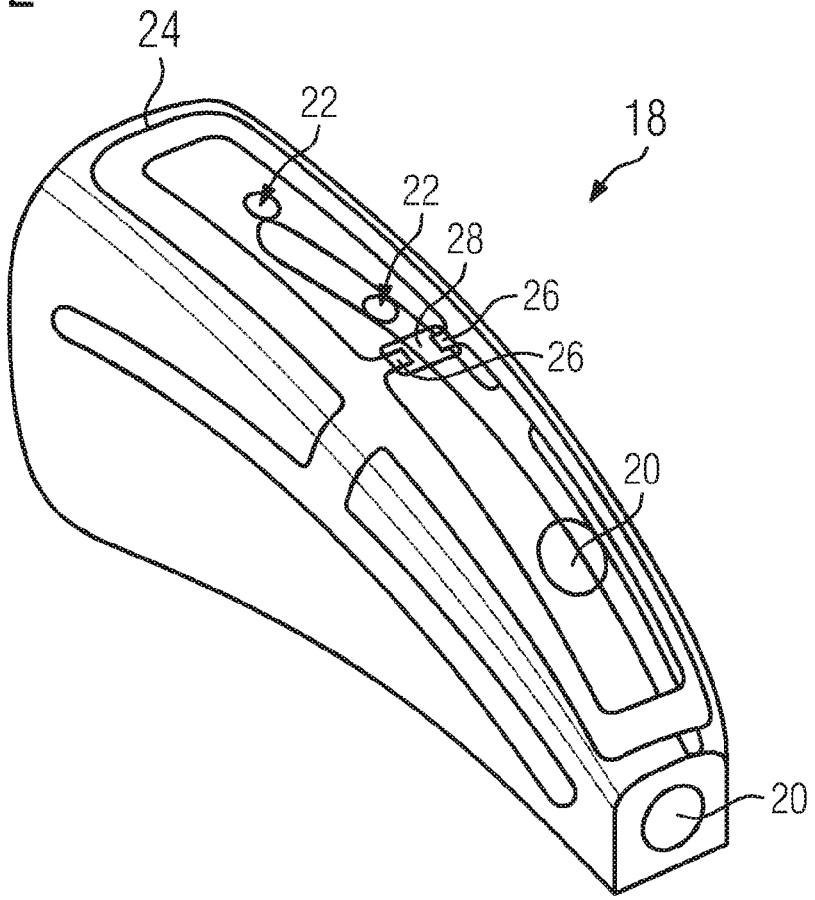
FIG. 2 is a perspective view of a sealing body of the hearing device shown in FIG. 1 with an antenna body integrated therein.
Figure 3:
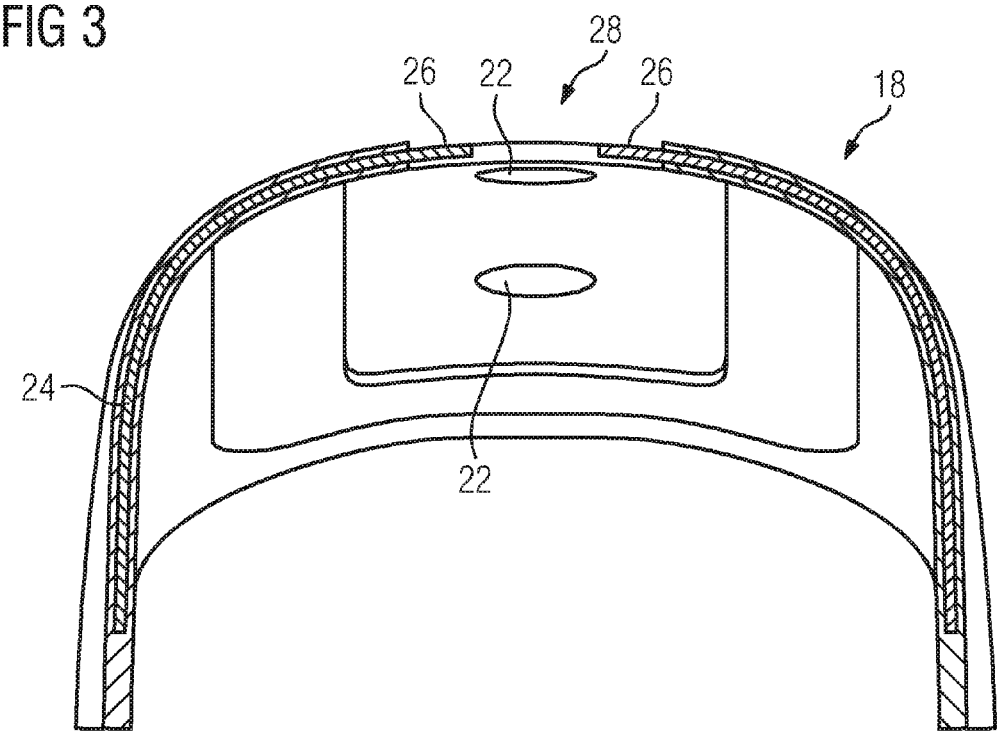
FIG. 3 is a cross-sectional view of the sealing body shown in FIG. 2.

As FIGS. 2 and 3 show, the sealing body 18 is modeled on the (shell) shape of the housing cap 14. Consequently, the sealing body 18 also has a half-shell shape. In this case, the sealing body 18 is fitted over the electronic components of the hearing device 1 during assembly to the same extent as the housing cap 14. The sealing body 18 has two perforations corresponding to the microphones 4 (subsequently referred to as microphone passages 20). The perforations are disposed in alignment with two microphone openings (not shown in more detail) in the housing cap 14 in the intended assembled state shown in FIG. 1. Furthermore, the sealing body 18 in the present exemplary embodiment also has openings for a "user interface," such as e.g. pushbutton switches (not shown in more detail). These openings are subsequently referred to as interface passages 22.

The hearing device 1 is additionally set up for wireless signal transmission with an electronic device that is separate from the hearing device 1. To this end, the hearing device 1 includes an antenna body 24 that is set up and provided for receiving radio signals. This antenna body 24 is embedded in the sealing body 18, specifically it is injection-molded therein. The antenna body 24 has two lugs, each referred to as a contact section 26, that are disposed in a (contact) window 28 in the sealing body 18 and hence are not embedded in the sealing body 18. The contact sections 26 are provided for purpose of contact connection from the antenna body 24 to the circuit carrier and hence to the signal processing unit 8. In an alternative exemplary embodiment, which is not shown in more detail, the contact sections 26 protrude from a lateral edge of the sealing body 18. In the intended assembled state shown in FIG. 1, the antenna body 24 is connected to the circuit carrier by using these contact sections 26 through a solder joint.

The antenna body 24 has a three-dimensionally curved, two-dimensional and film-shaped structure (in a similar form to the sealing body 18). Specifically, the antenna body 24 is formed from multiple film-shaped—i.e. thin in comparison with the covered surface area—strip-shaped sections made of metal (copper). This forms a large effective antenna surface area with comparatively little outlay in terms of materials. The integration of the antenna body 24 in the sealing body 18 additionally improves the handlability of the antenna body 24 during assembly, since the sealing body 18 carries (i.e. supports) the film-shaped structure of the antenna body.

The sealing body 18 is injection molded from an LSR (liquid silicone rubber). As a result, the sealing body 18 has high thermal stability, so that the sealing body 18 is not damaged when the contact sections 26 are soldered.

Figure 4:
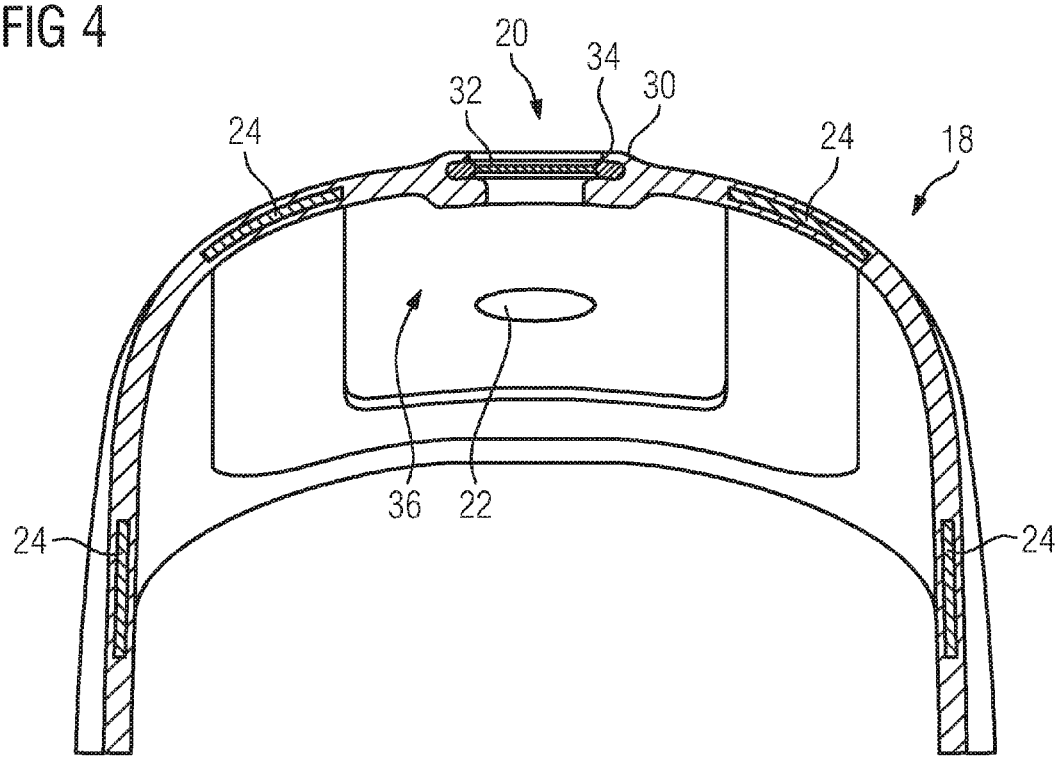
FIG. 4 is a view similar to FIG. 3 of a further exemplary embodiment of the sealing body.

FIG. 4 shows a further exemplary embodiment of the sealing body 18. In this case, the sealing body 18 has two damping sections 30 that are each associated with one of the microphone passages 20. Specifically, the damping sections 30 are local thickenings of the sealing body 18 that are used to support the two microphones 4 against the housing cap 14 in elastically resilient fashion. In order to prevent moisture and other contaminants from passing through the microphone openings in the housing cap 14 into the interior of the housing 2, specifically as far as the respective microphone 4, the hearing device 1 has a respective barrier element 32 associated with the respective microphone 4. This barrier element 32 is formed by a sound-transmissive, hydrophobic membrane that is stretched by an annular frame. The respective barrier element 32 is retained reversibly in the sealing body 18 within the respective microphone passage 20. Specifically, the respective microphone passage 20 has an undercut in which the respective barrier element 32 is inserted by utilizing the elastic deformability of an edge 34, facing the housing cap 14, of the respective microphone passage 20. In the intended assembled state of the hearing device 1 shown in FIG. 1, the respective microphone 4 abuts the respective damping section 30 from an inside 36 of the sealing body 18 and pushes the opposite edge 34 against the housing cap 14 in a sealing manner.

The subject matter of the invention is not limited to the exemplary embodiments described above. Rather, further embodiments of the invention can be derived from the above description by a person skilled in the art. In particular, the individual features of the invention that are described on the basis of the various exemplary embodiments, and variant refinements of those individual features, can also be combined with one another in other ways.

The invention claimed is:

1. A hearing device, comprising:

a housing having an interior, a basic body, an assembly opening, a housing cap and a closing edge formed between said basic body and said housing cap, said housing cap closing said assembly opening along said closing edge;

a signal processing unit disposed in said housing;

a sealing body disposed in said interior of said housing for sealing said closing edge from inside said housing against an ingress of contaminants; and an antenna body for wireless communication with a separate device, said antenna body being embedded in said sealing body.

2. The hearing device according to claim 1, wherein said antenna body has a two-dimensional, film-shaped structure.

3. The hearing device according to claim 1, wherein said antenna body is molded-over with a plastic forming said sealing body.

4. The hearing device according to claim 3, wherein said plastic is an elastomer.

5. The hearing device according to claim 1, wherein said sealing body is formed as a half-shell permitting said sealing body, in an intended assembled state, to at least partly cover said signal processing unit as a hood.

6. The hearing device according to claim 1, wherein said antenna body has an exposed contact section placing said antenna body in contact with said signal processing unit through a solder joint.

7. The hearing device according to claim 1, which further comprises at least one microphone for capturing acoustic signals, said sealing body having at least one damping section for elastically supporting said at least one microphone against said housing.

8. The hearing device according to claim 7, wherein said housing has at least one microphone opening corresponding to said at least one microphone, and said sealing body has at least one perforation, in a vicinity of said at least one damping section, corresponding to said at least one microphone opening in an intended assembled state.

9. The hearing device according to claim 8, wherein said at least one perforation contains a barrier element, in a reversibly insertable form, for protecting said at least one microphone against moisture.

10. The hearing device according to claim 1, wherein said assembly opening provides access for assembling microphones, said signal processing unit and a loudspeaker in said housing.

* * * * *